US005676254A

United States Patent [19]

Cheng et al.

[11] Patent Number: 5,676,254

[45] Date of Patent: Oct. 14, 1997

[54] STRUCTURE OF TOOL BOX

[76] Inventors: Chin-Shun Cheng; Yu-Tsang Lee, both of No. 4, Lane 326, Peng-Yi Road, Tai-Ping Hsiang, Taichung, Taiwan

[21] Appl. No.: 661,753

[22] Filed: Jun. 11, 1996

[51] Int. Cl.[6] ..... B65D 85/20

[52] U.S. Cl. ..... 206/751; 206/373; 206/759

[58] Field of Search ..... 206/373, 372, 206/379, 378, 377, 472–475, 751, 759

[56] References Cited

U.S. PATENT DOCUMENTS

| | | | |
|---|---|---|---|
| 4,660,719 | 4/1987 | Peterson et al. | 206/372 |
| 4,955,478 | 9/1990 | Rau et al. | 206/379 |
| 5,006,066 | 4/1991 | Rouse | 206/379 |
| 5,098,235 | 3/1992 | Svetlik et al. | 206/379 |
| 5,108,287 | 4/1992 | Yee et al. | 206/379 |
| 5,114,007 | 5/1992 | Chen | 206/373 |
| 5,312,250 | 5/1994 | Ellman et al. | 206/379 |
| 5,368,164 | 11/1994 | Bennett et al. | 206/373 |
| 5,497,875 | 3/1996 | Kuo | 206/751 |
| 5,570,784 | 11/1996 | Sidabras et al. | 206/759 |

*Primary Examiner*—Jimmy G. Foster
*Assistant Examiner*—Luan K. Bui
*Attorney, Agent, or Firm*—Bacon & Thomas

[57] ABSTRACT

A tool box including a tool box body defining a plurality of open chambers, and a plurality of tool bit holders mounted in the open chambers for holding elongated tool bits and accessories, wherein each open chamber has a first pivot at two opposite sides, a bottom wall formed of a front bottom wall section and a rear bottom wall section disposed at different elevations; each tool bit holder has a second pivot at two opposite sides respectively pivoted to the first pivot of one open chamber, a plurality of elongated slots disposed in parallel, a plurality of access holes formed in the front side and axially aligned with the elongated slots, two upright blocks bilaterally extending from the top side near two opposite ends of the front side.

7 Claims, 4 Drawing Sheets

STRUCTURE OF TOOL BOX

BACKGROUND OF THE INVENTION

The present invention relates to tool boxes, and relates more particularly to such a tool box which has a plurality of tool bit holders pivotably mounted in respective open chambers in the tool box body thereof and adapted for holding elongated tool bits.

A variety of tool boxes have been disclosed for keeping tool, tool bits, and tool accessaries in good order. However, conventional tool boxes are not convenient in use for holding elongated tool bits or tool accessories. When elongated tool bits or tool accessories are respectively mounted in respective grooves in the tool box body, they are constantly maintained inside the respective grooves when the cover of the tool box is either closed or opened. Therefore, it is difficult to remove the tool bits or tool accessories from the respective grooves.

SUMMARY OF THE INVENTION

The present invention has been accomplished to provide a tool box which eliminates the aforesaid problem. It is one object of the present invention to provide a tool box which is specifically designed for holding elongated tool bits and tool accessories. It is another object of the present invention to provide a tool box which automatically turns the stored objects from a horizontal position to a tilted position upon the opening of the tool box cover, so that the stored objects can be conveniently taken out of the tool box. According to one embodiment of the present invention, the tool box comprises a base defining a plurality of open chambers, a cover hinged to the base, and a plurality of tool bit holders mounted in the open chambers and adapted for holding elongated tool bits therein. Each open chamber comprises two pivot holes at two opposite sides, a bottom wall formed of a front bottom wall section and a rear bottom wall section disposed at different elevations. Each tool bit holder comprises a plurality of elongated slots disposed in parallel, a plurality of access holes formed in a front side thereof and respectively axially aligned with the elongated slots, two upright blocks bilaterally raised from the top side near two opposite ends of the front side, and two pivot pins respectively raised from two opposite lateral sides thereof and mounted in the pivot holes of one open chamber. When the cover is closed, a downward pressure is given to the upright blocks of each tool bit holder, causing the tool bit holders to be turned to a horizontal position. When the cover is opened, the tool bit holders are released from the pressure, and forced by their weight to turn under gravity from the horizontal position to a tilted position convenient for the loading or removal of tool bits. According to an alternate form of the present invention, each open chamber has two pivot pins at two opposite sides, and each tool bit holder has two invertedly disposed U-grooves at two opposite lateral sides respectively and pivotably coupled to the two pivot pins of one open chamber.

DETAILED DESCRIPTION OF THE PREFERRED EMBODIMENTS

Figure 1:
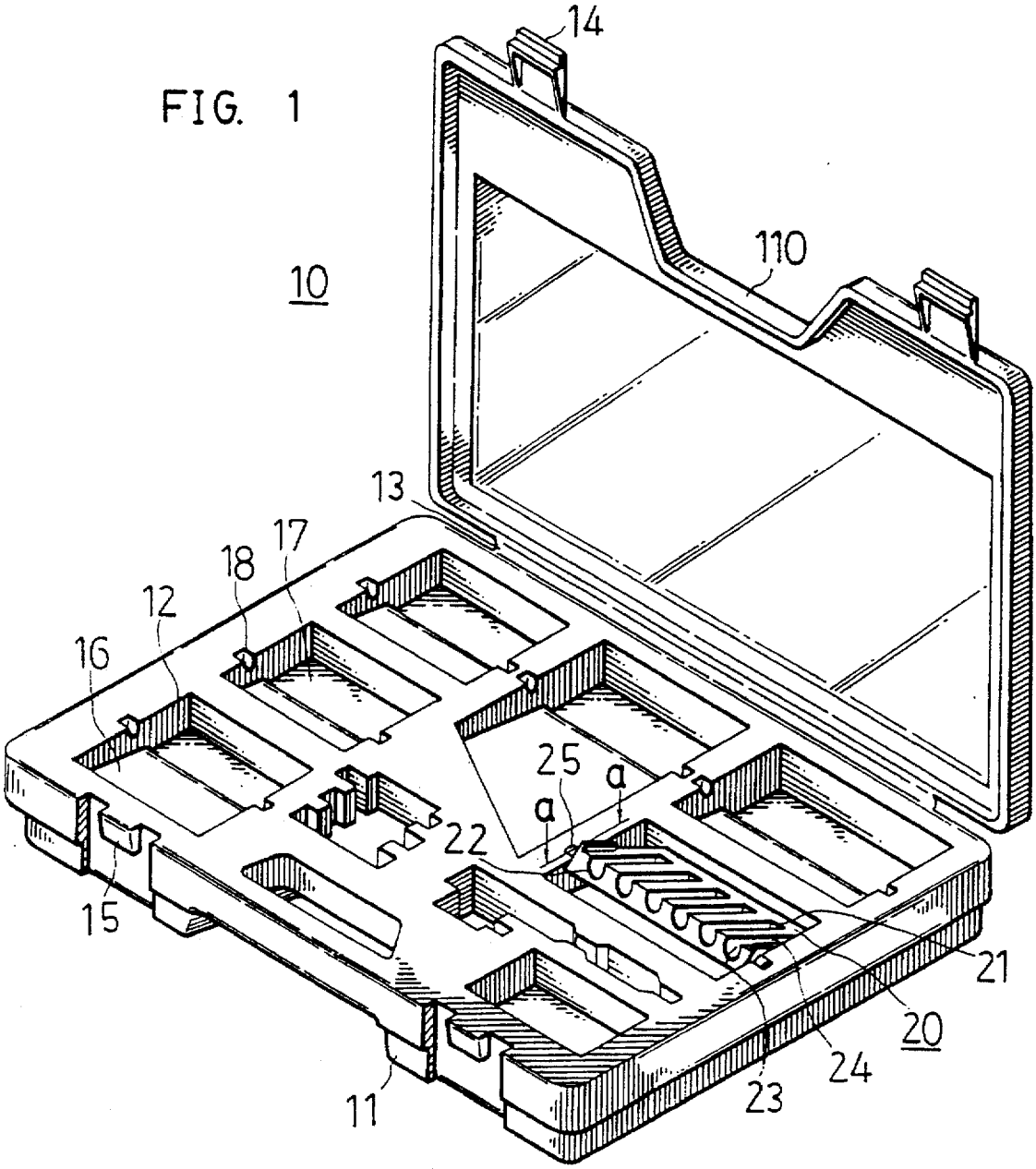
FIG. 1 is an elevational view of one embodiment of the present invention, showing the tool box opened.
Figure 2:
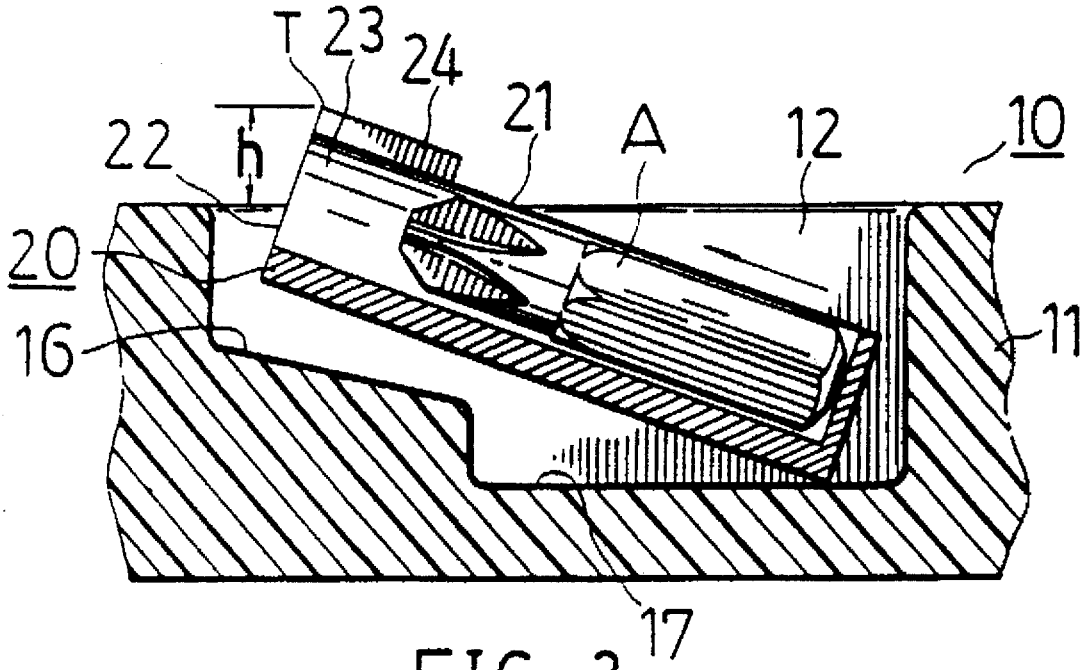
FIG. 2 is a sectional view of a part of the present invention, showing the tool bit holder positioned in the rear wall section of the open chamber in a tilted position.
Figure 3:
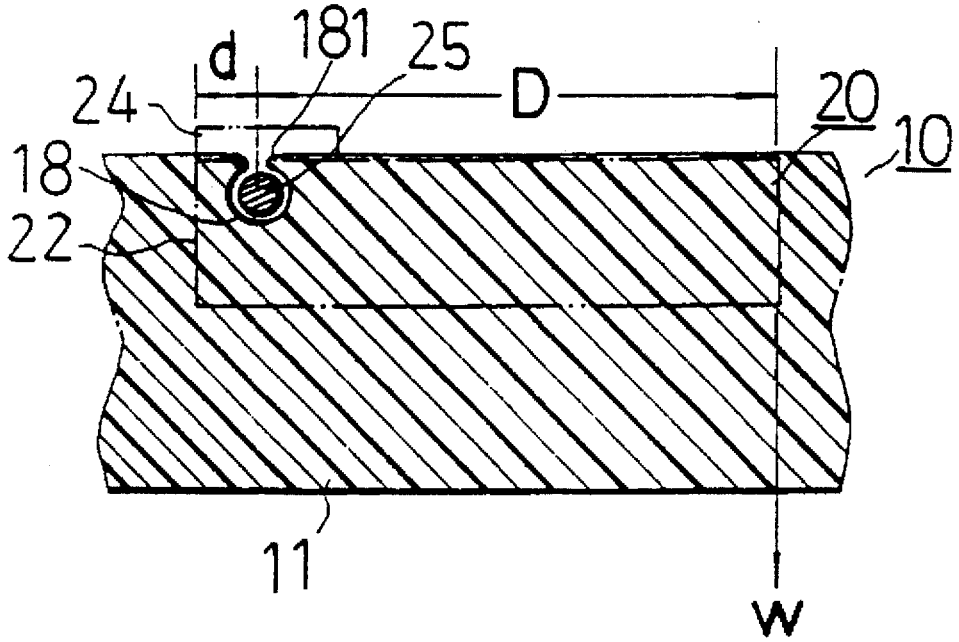
FIG. 3 is a sectional view taken along line a—a of FIG. 1.

Referring to FIGS. 1, 2, and 3, a tool box in accordance with the present invention is comprised of a tool box body 10, and a plurality of rectangular tool bit holders 20. The tool box body 10 is made by a blow molding process, comprising a base 11, a cover 110, and a hinge 13 integrally connected between the base 11 and the cover 110. The cover 110 comprises two female retainer elements 14 extending from one side thereof remote from the hinge 13, and adapted for coupling to respective male retainer elements 15 at the base 11. A plurality of open chambers 16 are formed in the top side of the base 11, and adapted for receiving the tool bit holders 20.

Referring to FIGS. 2 and 3, and FIG. 1 again, each of the rectangular tool bit holders 20 comprises a plurality of elongated slots 23 transversely disposed in parallel, a plurality of elongated, narrow openings 21 transversely formed in the top side thereof and respectively disposed in communication with the elongated slots 23, a plurality of circular holes 22 formed in the front side thereof, two upright blocks 24 bilaterally raised from the top side near the two opposite ends of the front side, and two pivot pins 25 respectively extending from two opposite lateral sides thereof. The circular holes 22 are respectively connected to the narrow openings 21 at right angles, and coincide with the front ends of the elongated slots 23. The longitudinal length of the open chambers 12 is slightly longer than that of the tool bit holders 20 so that the tool bit holders 20 can be received in the open chambers 12. Each of the open chambers 12 comprises a stepped bottom wall formed of a front bottom wall section 16 and a rear bottom wall section 17. The front bottom wall section 16 can be a flat surface disposed at a higher elevation thant the rear bottom wall section 17. Alternatively, the front bottom wall section 16 can be a slope downwardly sloping to the rear bottom wall section 17. The base 11 further comprises pairs of axle grooves 18 respectively formed in the top side of the base 11 at two opposite ends of each open chamber 12, and pairs of opposing springy flanges 181 respectively extending inwardly from two opposite sides of each axle groove 18 and disposed in flush with the top side of the base 11.

Referring to FIGS. from 1 to 3 again, the tool bit holders 20 are respectively mounted in the open chambers 12 of the base 11 by forcing the pivot pins 25 through the gap between each pair of opposing springy flanges 181 into the axle grooves 18. When installed, each tool bit holder 20 has a weight w. The arm of force d between the front side of each tool bit holder 20 and the longitudinal center axis of the pivot pins 25 of the respective tool bit holder 20 is shorter than the arm of force D between the back side of each tool bit holder 20 and the longitudinal center axis of the pivot pins 25 of the respective tool bit holder 20. Therefore, the weight w is shifted to the end of the arm of force D, causing the tool bit holder 20 to turn about the axis on the pivot pins 25 and then to position in the rear bottom wall section 17 in a tilted position convenient for the loading or removal of rod-like tool bits, for example, tips for screwdriver A. Because the upright blocks 24 are bilaterally extended from the top side near the two opposite ends of the front side, there is a difference of elevation h between the topmost edge T of the upright blocks 24 and the top side of the tool bit holder 20. Therefore, when the cover 110 of the tool box body 10 is closed, a downward pressure is given to the upright blocks 24, causing the tool bit holder 20 to turn about the axis on the pivot pins 25 from the tilted position to the horizontal position. Once the cover 110 of the tool box body 10 is opened again, the pressure is released from the upright blocks 24, and the tool bit holder 20 is forced by its gravity to turn backwardly about the axis on the pivot pins 25 and then to position in the rear bottom wall section 17 in the tilted position. When it is desired to remove a tool bit A from one slot 23 of one tool bit holder 20, the fingers can be inserted into the narrow opening 21 to push the tool bit A forwards to the circular hole 22. When the tool bit A protrudes over the circular hole 22, it can then be conveniently removed from the tool bit holder 20.

Figure 4:
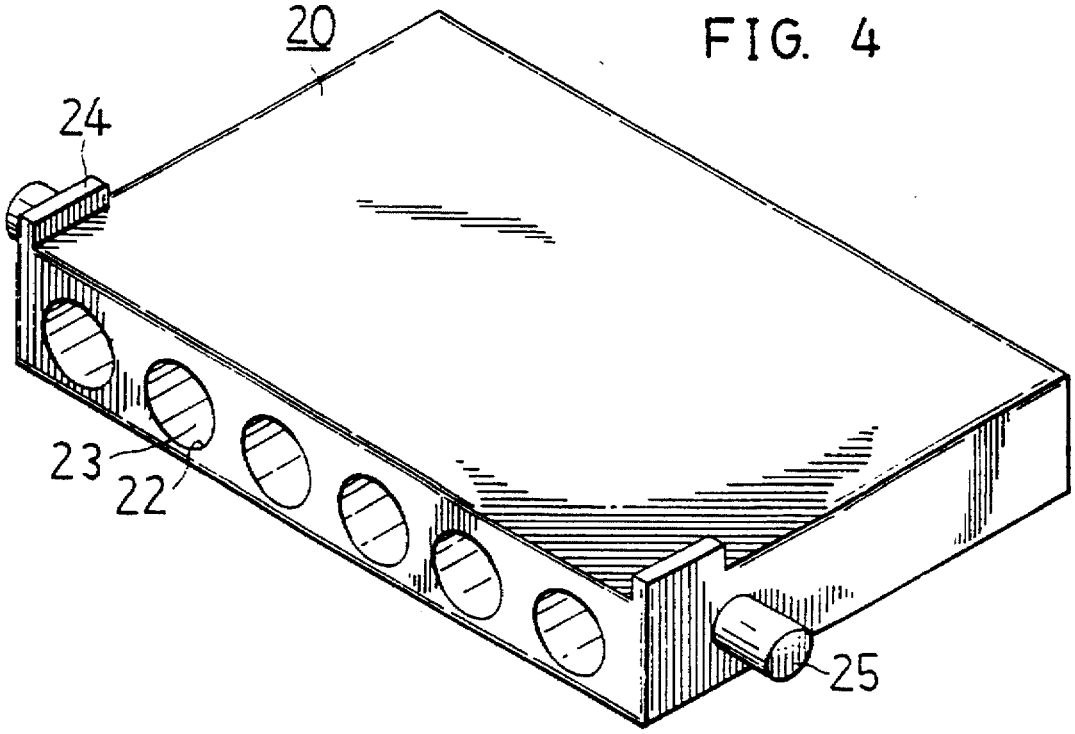
FIG. 4 is an elevational view of an alternate form of the tool bit holder according to the present invention.

FIG. 4 shows an alternate form of the tool bit holder 20. According to this alternate form, the tool bit holder 20 comprises a plurality of elongated slots 23 transversely disposed in parallel, a plurality of circular holes 22 formed in the front side thereof and coinciding with the front ends of the elongated slots 23 respectively, two upright blocks 24 bilaterally raised from the top side near the two opposite ends of the front side, and two pivot pins 25 respectively extending from two opposite lateral sides thereof. This alternate form eliminates the aforesaid narrow openings 21, and is designed for holding tool bits longer than that of the elongated slots 23.

Figure 5:
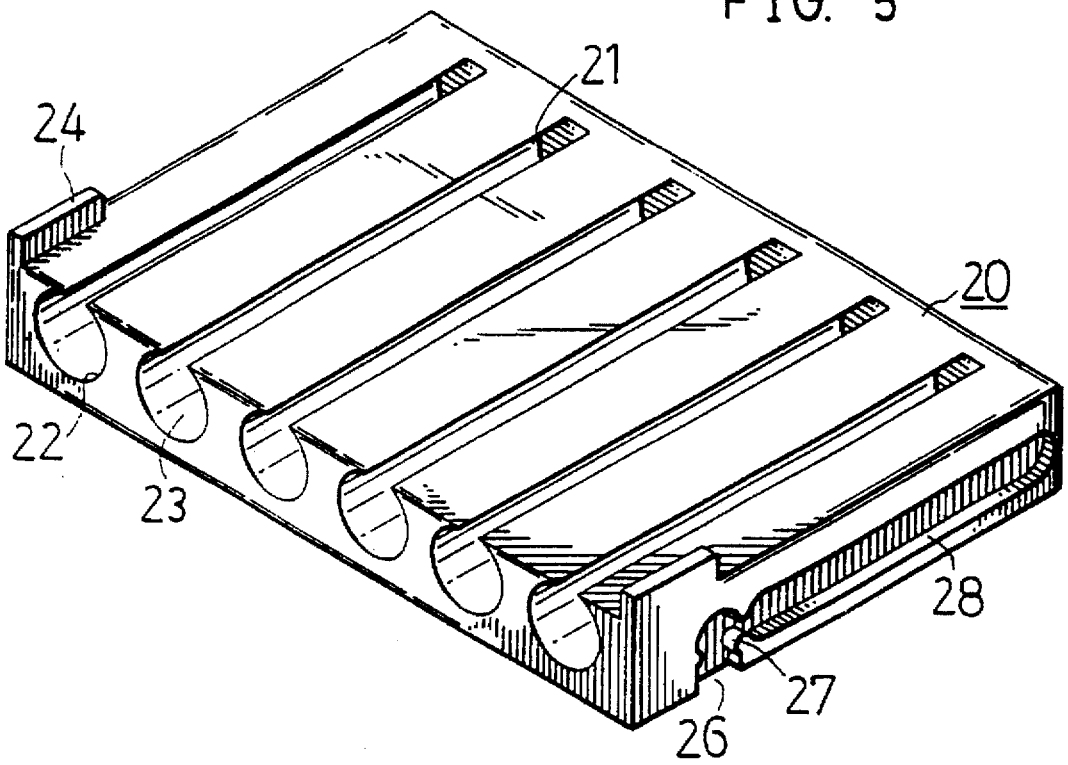
FIG. 5 is an elevational view of another alternate form of the tool bit holder according to the present invention.
Figure 6:
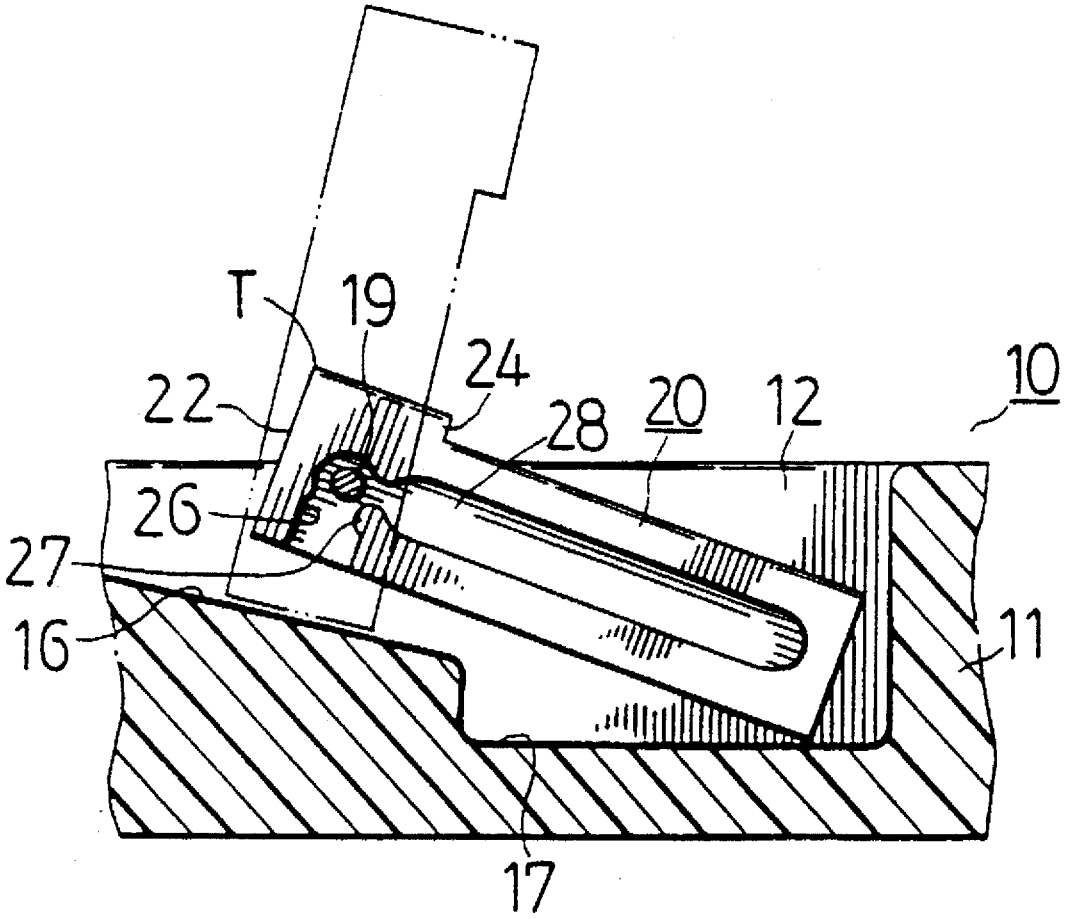
FIG. 6 is a sectional view showing the application of the alternate form of the tool bit holder of FIG. 5.

FIG. 5 shows another alternate form of the tool bit holder. This alternate form comprises a plurality of elongated slots 23 transversely disposed in parallel, a plurality of elongated, narrow openings 21 transversely formed in the top side thereof and respectively disposed in communication with the elongated slots 23, a plurality of circular holes 22 formed in the front side thereof and coinciding with the front ends of the elongated slots 23, two upright blocks 24 bilaterally extending from the top side near the two opposite ends of the front side, two invertedly disposed U-grooves 26 bilaterally disposed at two opposite lateral sides adjacent to the upright blocks 24, two elongated sliding grooves 28 bilaterally disposed at the two opposite lateral sides and respectively backwardly extending from the U-grooves 26, and two pairs of inward flanges 27 bilaterally disposed in the U-grooves 26. To match with this alternate form of tool bit holder, the open chamber 12 of the base 11 is equipped with two pivot pins 19 at two opposite sides adapted for inserting into the U-grooves 26 for permitting the tool bit holder 20 to be turned therabout (see also FIG. 6). The pivot pins 19 are inserted into the U-grooves 26 from the open bottom side, and forced upwards to pass through the gap between the inward flanges 27 into the inside of the U-grooves 26. When installed, as shown in FIG. 6, the tool bit holder 20 is positioned in the rear bottom wall section 17 in a tilted position, and can be turned about the pivot pins 19. The tool bit holder 20 can be pulled out of the rear bottom wall section 17 and supported on the front bottom wall section 16 for the convenient loading or removal of the tool bit. When the tool bit holder 20 is pulled outwards, the pivot pins 19 are moved from the U-grooves 26 to the sliding grooves 28.

It is to be understood that the drawings are designed for purposes of illustration only, and are not intended as a definition of the limits and scope of the invention disclosed.

What the invention claimed is:

1. A tool box for holding elongated tools comprising:

a) a base having a plurality of open chambers formed therein and a cover hinged to the base for opening and closing the base;

b) each open chamber being partially defined by a pair of opposed side walls and a bottom wall including a front bottom wall section and a rear bottom wall section, with the rear bottom wall section being disposed at a lower elevation than the front bottom wall section;

c) a tool holder disposed within each open chamber, the tool holder including a plurality of parallel elongated slots extending from a front side to a back side of the holder, each elongated slot including an access hole at the front side of the holder for receiving an elongated tool therein, a top side, a pair of opposed sides, and a block means extending upwardly from the top side for engagement by the cover during closing of the base; and d) means for pivotally mounting each tool holder to the opposed side walls of the open chamber whereby the pivot axis is positioned transverse to the longitudinal axes of the elongated slots and towards the front side of the holder to permit the back side of the holder to automatically pivot downwardly under the force of gravity towards the rear bottom wall section of the open chamber and dispose the access holes in an upwardly facing position for inserting the elongated tools into and removing the elongated tools from the elongated slots when the cover is in an open position.

2. The tool box of claim 1 wherein the means for pivotally mounting the tool holder to the opposed side walls of the open chamber includes a pivot pin extending from each side of the tool holder, a pivot hole formed in each side wall of the open chamber, and the pivot pins being pivotally engaged within the pivot holes.

3. The tool structure of claim 1 wherein the means for pivotally mounting the tool holder to the opposed side walls of the open chamber includes, a pair of pivot pins extending inwardly from the opposed side walls of the open chamber, an inverted U-shaped groove formed in each side of the tool holder, and the pivot pins being pivotally engaged within the U-shaped grooves.

4. The tool box of claim 3 further including an elongated sliding groove extending rearwardly from each U-shaped groove and a pair of inwardly directed flanges between the U-shaped groove and the elongated sliding groove.

5. The tool box of claim 1 wherein each elongated slot further includes an elongated narrow opening extending along the top side of the tool holder.

6. The tool box of claim 1 wherein the front bottom wall section of each open chamber slopes downwardly towards the rear bottom wall section.

7. The tool box of claim 1 wherein the block means extending upwardly from the top side of each tool holder includes a pair of blocks, with each block being disposed adjacent a side of the tool holder.

* * * * *